United States Patent [19]

Armitage

[11] Patent Number: 4,953,474

[45] Date of Patent: Sep. 4, 1990

[54] FUEL METERING BIN LEVEL CONTROL

[75] Inventor: Albert Armitage, Milton, Wash.

[73] Assignee: Westinghouse Electric Corp., Pittsburgh, Pa.

[21] Appl. No.: 470,472

[22] Filed: Jan. 26, 1990

[51] Int. Cl.[5] ..... F23K 3/00

[52] U.S. Cl. ..... 110/101 CD; 110/101 C; 110/102; 222/64; 414/161

[58] Field of Search ..... 110/101 A, 101 CD, 101 C, 110/102; 414/161; 222/64

[56] References Cited

U.S. PATENT DOCUMENTS 3,822,657 7/1974 Midkiff ..... 110/101 CD
4,445,628 5/1984 Cain ..... 110/101 CD X
4,513,671 4/1985 Eshleman ..... 110/101 CD X
4,598,670 7/1986 Clamser et al. ..... 110/101 CD X

*Primary Examiner*—Edward G. Favors
*Attorney, Agent, or Firm*—Fred J. Baehr, Jr.

[57] ABSTRACT

A fuel metering bin level control for a wood chip bin feeding a boiler wherein the wood chips have a high propensity to bridge the bin when packed, the level control includes a short chute through which the chips are fed into the upper portion of the bin and a pair of doors in the chute are opened and closed by pneumatic cylinders operating through four bar linkages in response to signals from a level transmitter to maintain the level of wood chips in the fuel metering bin within a range that prevents the chips from bridging the bin and allows the feed to the bin to be continuous with excess chips being diverted to a silo for storage and future use.

8 Claims, 2 Drawing Sheets

FUEL METERING BIN LEVEL CONTROL

BACKGROUND OF THE INVENTION

The invention relates to a power plant utilizing wood chips as the fuel and more particularly to a fuel metering bin level control.

When operating a power plant fueled by wood chips, the wood chips are brought in by the truck load, dumped on a conveyer, which carries them to a disc screen that removes oversize chips. The oversize chips are routed to a hammer mill wherein the size is reduced sufficiently to be combined with the chips that passed through the disc screen. These chips are transported by a conveyor to a metering bin. From the metering bin the chips are fed at a controlled rate to a stoker and fire a boiler to produce steam to operate a turbine generator set to make electricity. When the metering bin is full, an augur moves the excess wood chips to another conveyor, which delivers them to a silo for storage. The stored chips are used to maintain the fuel supply when new chips are not being trucked into the plant. One of the problems is that filling the metering bin results in the chips becoming packed therein to such an extent that they bridge over the metering bin creating a void as chips are fed from the bottom of the bin into the boiler. The bridging eventually cuts off the fuel to the boiler. The only successful way to cure the bridging was to regularly allow the metering bin to empty, by shutting down the conveyor from the fuel yard. This slowed down the truck unloading operation, substantially increasing the time required to unload the daily quota of trucks.

SUMMARY OF THE INVENTION

Among the objects of the invention may be noted the provision of a fuel metering bin level control for a boiler burning wood chips, wherein bridging of the metering bin by the wood chips is eliminated without shutting down the fuel feed conveyors.

In general, a fuel metering bin level control for a fuel bin having a feed conveyor which supplies wood chips to the metering bin, an auger conveying system for moving chips across the top of the bin, and a storage conveyor for transferring excess chips from the metering bin to a storage silo, when made in accordance with this invention, comprises an opening at the bottom of the auger conveyor, a chute extending downwardly from the opening, means for opening and closing off the bottom of the chute, and means for responding to the level of wood chips in the metering bin to operate the chute opening and closing means to close the chute when the level of wood chips in the fuel metering bin reaches a level above a predetermined level and to open the chute when a level below the predetermined level is reached to prevent bridging of the wood chips in the metering bin.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

DESCRIPTION OF THE PREFERRED EMBODIMENT

Figure 1:
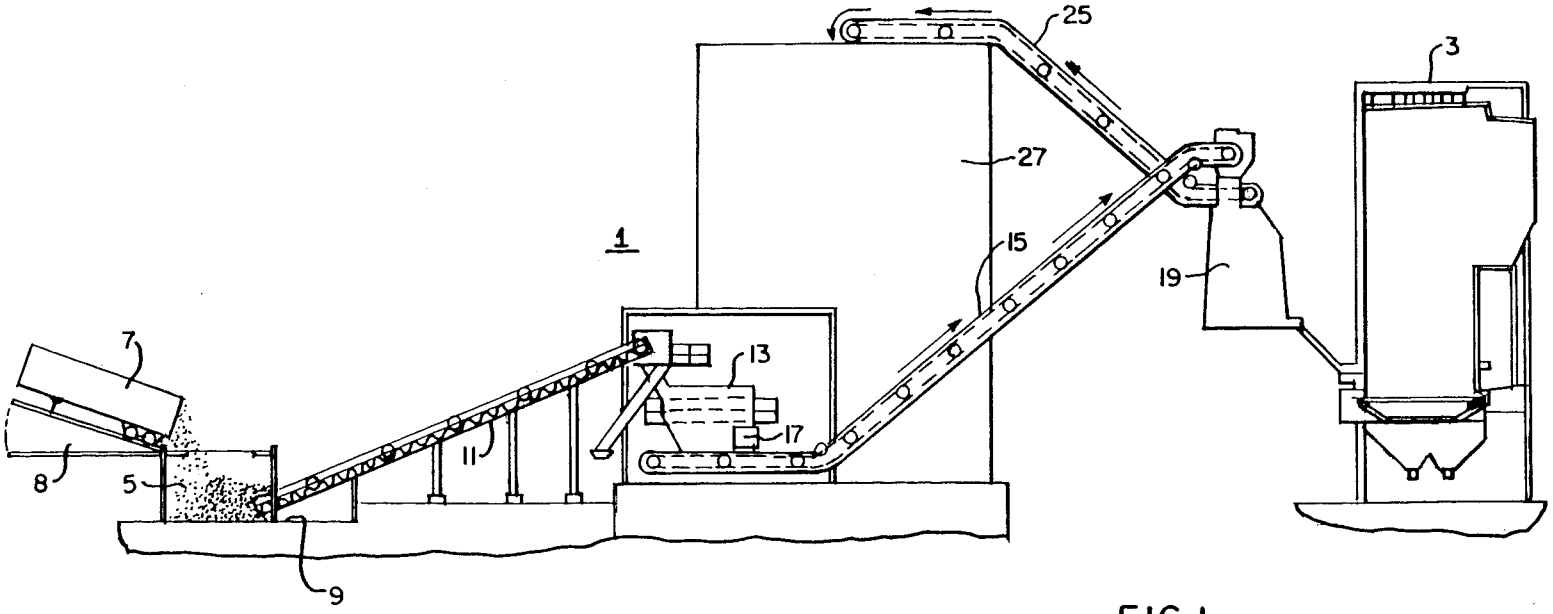
FIG. 1 is a schematic view of a wood chip feed system for a boiler.
Figure 2:
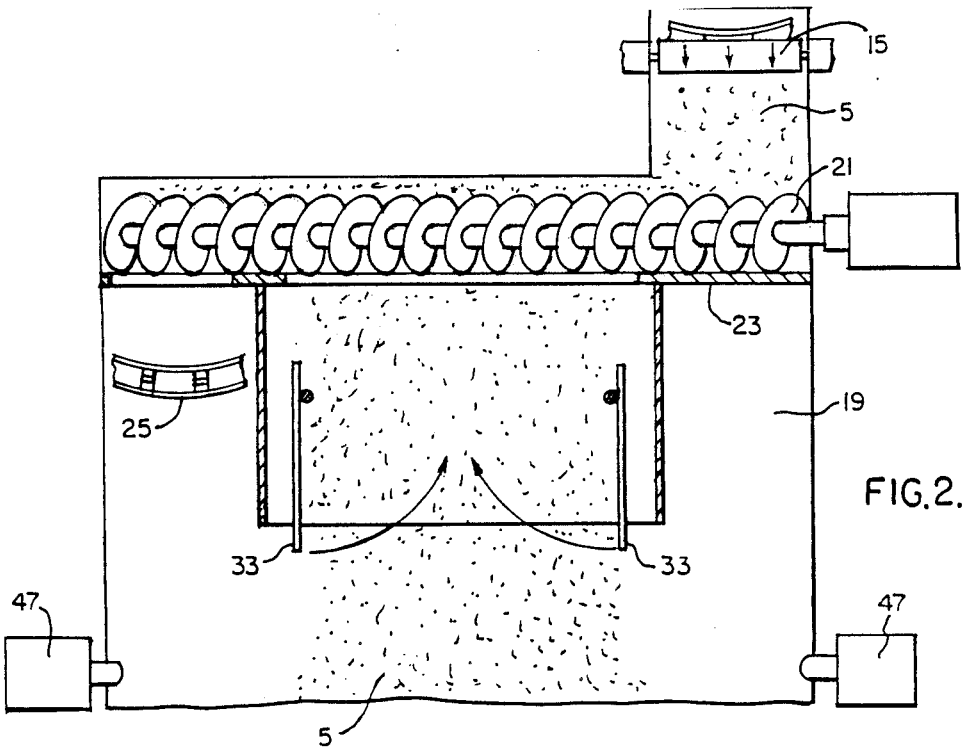
FIG. 2 is a schematic view of the feed and transfer to storage arrangement associated with the fuel metering bin.

Referring now to the drawings in detail and in particular to FIG. 1 there is shown a wood chip feed and storage system 1 for a boiler 3, which utilizes wood chips 5 as a fuel. The wood chips are brought in by the truck load. Trailers 7 are backed on a hydraulic lift 8 and dumped into a pit 9 where the chips 5 are picked up by a first conveyor 11 and dumped on a disc screen 13. The smaller chips 5 pass through the disc screen 13 to a second conveyor 15, while the larger pieces of wood which will not pass through the disc screen 13 are delivered to a hammer mill 17. The hammer mill 17 reduces the wood to smaller sized chip and discharges the smaller chips to the second conveyor 15 where they combine with the chips passed through the disc screen 13. The second conveyor 15 moves the wood chips 5 to the top of a fuel metering bin 19 where they are fed to a screw conveyor or auger 21, as shown in FIG. 2. The auger 21 moves the chips across an opening 23 which allows them to fall into the fuel metering bin 19. When the wood chips build up filling the opening the auger 21 transfers the wood chips to a third conveyor 25 which carries the wood chips 5 to a storage silo 27. Wood chips 5 from the silo 27 feed the second conveyor 15 when there are no trucks bringing new wood chips 5 into the plant.

Figure 3:
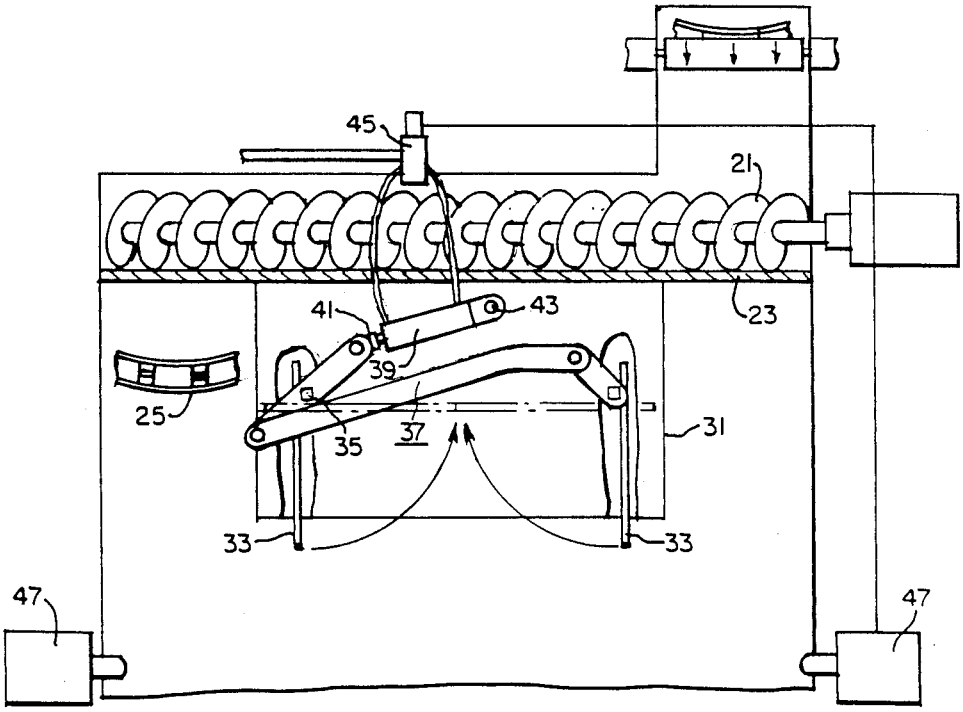
FIG. 3 is a schematic view of a fuel metering bin control system.

As shown in FIG. 3 a fuel metering level control comprises a chute 31 extending a short distance downwardly away form the opening 23. The chute 31 is generally a cube formed from a square duct which is generally of equal width, depth and height, but could be any shape. A pair of rectangular plates 33, which together generally extend across the bottom portion of the square chute 31, are affixed adjacent opposite outboard margins to a pair of round rods or shafts 35, one for each plate 33. The shafts 35 are pivotally mounted on the chute 31 and have squared off ends for receiving a pair of four bar linkages 37 connected to each end of the shafts 35 on opposite sides of the chute 31 causing the plates 33 to move in unison in opposite clock directions to open and close the bottom of the chute 31. A pneumatic cylinder 39 is attached to each four bar linkage 37 and to the chute 31 by clevis arrangements 41 and 43 to open and close the bottom of the chute 31. The pneumatic cylinders 39 are each operated by a solenoid valves 45, which may be operated manually from a switch in the control room (not shown) or from a sonic level transmitter or other level indicator means 47 to open the bottom of the chute 31, when the level of wood chips 5 in fuel metering bin 19 drops below a predetermined low level and to close the bottom of the chute 31, when the level of wood chips 5 in the fuel metering bin 19 reaches a predetermined high level. Thus, providing a completely redundant system by having two four bar linkages 37, two pneumatic cylinders 39 and two solenoid valves 45 even though each set can operate to open and close the plates 33.

Wood chips 5 have a propensity to pack and bridge over due to their irregular shape, light weight and flexibility. The fuel metering level control described herein advantageously prevents bridging of the wood chips in the fuel metering bin, allows continuous operation of truck unloading and diversion of wood chips to the silo 27, while maintaining continuous control of the fuel flow to the boiler 3.

While the preferred embodiments described herein set forth the best mode to practice this invention presently contemplated by the inventor, numerous modifications and adaptations of this invention will be apparent to others skilled in the art. Therefore, the embodiments are to be considered as illustrative and exemplary and it is understood that the claims are intended to cover such modifications and adaptations as they are considered to be within the spirit and scope of this invention.

What is claimed is:

1. A fuel metering bin level control for a fuel bin having a feed conveyor which supplies fuel to the metering bin, a an auger conveying system for moving fuel across the top of the bin, and a storage conveyor for transferring excess fuel from the metering bin to a storage silo, said fuel metering bin level control comprising an opening at the bottom of the auger conveyor, a chute extending downwardly from said opening, means for opening and closing off the bottom of said chute, and means for responding to the level of fuel in said metering bin to operate said chute opening and closing means to close the chute when the level of fuel in the fuel metering bin reaches a level above a predetermined level and to open said chute when a level below the predetermined level is reached, whereby bridging of the fuel in the fuel metering bin is eliminated.

2. The fuel metering bin level control of claim 1, wherein the means for opening and closing the bottom of the chute comprises a pair of plates which together generally extend across the bottom portion of the chute, the plates being pivotally mounted to the chute adjacent opposite outboard ends of the plate, a four bar linkage connected to said pivotal mounts and an actuator cooperatively associated with said four bar linkage to operate said plates in unison to open and close the chute.

3. The fuel metering bin level control of claim 2, wherein the actuator is a pneumatic cylinder.

4. The fuel metering bin level control of claim 3, wherein the means for responding to the level of fuel in the metering bin is a sonic level transmitter which sends a signal to a solenoid valve to operate the pneumatic cylinder.

5. The fuel metering bin level control of claim 1, wherein the means for opening and closing the bottom of the chute comprises a pair of plates which together generally extend across the bottom portion of the chute, the plates being pivotally mounted to the chute adjacent opposite outboard ends of the plates, a pair of four bar linkages connected to said pivotal mounts on opposite sides of the chute and a pair of actuator, each of which is cooperatively associated with one of said four bar linkages to operate said plates in unison to open and close the chute.

6. The fuel metering bin level control of claim 5, wherein the actuators are pneumatic cylinders.

7. The fuel metering bin level control of claim 6, wherein the means for responding to the level of the fuel in the metering bin is a sonic level transmitter which sends a signal to a pair of solenoid valves each of which operates one of the pneumatic cylinders.

8. The fuel metering bin level control of claim 7, and further comprising a manually operated device for sending a signal to the solenoid valve to operate the pneumatic cylinder over riding the sonic level transmitter.

* * * * *